US012012659B2

(12) United States Patent
Toman

(10) Patent No.: US 12,012,659 B2
(45) Date of Patent: Jun. 18, 2024

(54) SYSTEM, METHOD AND APPARATUS FOR PROVIDING ANODIC CORROSION PROTECTION FOR GALVANIZED IRRIGATION PIPES

(71) Applicant: Valmont Industries, Inc., Omaha, NE (US)

(72) Inventor: Benjamin J. Toman, Omaha, NE (US)

(73) Assignee: Valmont Industries, Inc.

( * ) Notice: Subject to any disclaimer, the term of this patent is extended or adjusted under 35 U.S.C. 154(b) by 243 days.

(21) Appl. No.: 17/177,674

(22) Filed: Feb. 17, 2021

(65) Prior Publication Data

US 2021/0269925 A1 Sep. 2, 2021

Related U.S. Application Data

(60) Provisional application No. 62/982,806, filed on Feb. 28, 2020.

(51) Int. Cl.
*C23F 13/00* (2006.01)

(52) U.S. Cl.
CPC ..... *C23F 13/005* (2013.01)

(58) Field of Classification Search
CPC ..... C23F 13/005; C23F 13/02–13/22; C23F 2213/30–2213/32; F24H 9/40–9/457
See application file for complete search history.

(56) References Cited

U.S. PATENT DOCUMENTS 2,666,027 A * 1/1954 Vallett ..... C23F 13/02 204/196.15
2,947,680 A * 8/1960 Preiser ..... C23F 13/18 403/368
2,996,445 A * 8/1961 Eisenberg ..... C23F 13/18 204/290.14
3,135,677 A * 6/1964 Fischer ..... C23F 13/06 204/290.06
3,867,274 A * 2/1975 Herman ..... C23F 13/02 204/196.19

(Continued)

FOREIGN PATENT DOCUMENTS

DE 10011677 A1 * 9/2000 ..... C23F 13/02

OTHER PUBLICATIONS

Merriam-Webster, "Cap". (Year: 2024).*

*Primary Examiner* — Alexander W Keeling
(74) *Attorney, Agent, or Firm* — Milligan PC LLO

(57) ABSTRACT

The present invention provides a sacrificial anodic plug for insertion within an irrigation span to provide anodic corrosion protection. According to a preferred embodiment, the anodic plug of the present invention includes a protective cap connected to a securing bushing, and an anodic coupler which extends into the interior of the irrigation span. Preferably, the securing bushing includes non-conductive threads for mating with the threads of a sprinkler outlet and for electrically isolating the anodic coupler from the protective cap. According to further preferred embodiments, the anodic coupler is formed of magnesium and extends down away from the protective cap and terminates in an anodic base. According to a further preferred embodiment, the protective cap may include a wear indicator indicating the amount of anodic material remaining in the central anodic coupler and anodic base.

2 Claims, 5 Drawing Sheets

(56) References Cited

U.S. PATENT DOCUMENTS

| | | | | |
|---|---|---|---|---|
| 5,176,807 | A * | 1/1993 | Kumar | C23F 13/18 204/290.13 |
| 9,115,430 | B2 * | 8/2015 | McMullen | C23F 13/18 |
| 2009/0188787 | A1 * | 7/2009 | Closset | C23F 13/18 204/196.37 |
| 2017/0121828 | A1 * | 5/2017 | Simpson | C23F 13/20 |

* cited by examiner

SYSTEM, METHOD AND APPARATUS FOR PROVIDING ANODIC CORROSION PROTECTION FOR GALVANIZED IRRIGATION PIPES

RELATED APPLICATIONS

The present application claims priority to U.S. Provisional Application No. 62/982,806 filed Feb. 28, 2020.

BACKGROUND AND FIELD OF THE PRESENT INVENTION

Field of the Present Invention

The present invention relates generally to a system for protecting galvanized irrigation pipes. More specifically, the present invention provides a system, method and apparatus for providing anodic corrosion protection for galvanized irrigation pipes.

Background of the Invention

Pipeline corrosion remains a significant issue for mechanized irrigation in general. One long-standing and well known way of combating corrosion is the concept of cathodic protection, wherein a galvanic anode or anodes are placed into contact with a stream of water to protect adjacent metals. These anodes supply free electrons to the cathode and protect the cathode (e.g. span pipe) from corroding. As taught in the prior art, so long as the anodes are sized and placed adequately to supply these free electrons to the cathode (steel pipe) faster than oxygen from the environment, corrosion will be minimized or prevented.

Modern irrigation systems depend primarily on galvanized steel pipes (e.g. spans) to transport water from wells to needed areas. Currently, the solutions for irrigation systems involves installing a magnesium strip inside the pipeline, running along its entire length and affixed at both ends. While generally effective, the installed magnesium strips are difficult to install and fairly expensive to manufacture. Additionally, the strip anode degrades quickly over time necessitating frequent replacement which is difficult, expensive and time consuming.

SUMMARY OF THE DISCLOSURE

To minimize the limitations found in the prior art, and to minimize other limitations that will be apparent upon the reading of the specifications, the preferred embodiment of the present invention includes a system, method and apparatus for providing anodic corrosion protection for galvanized irrigation pipes.

According to a preferred embodiment, the present invention includes a sacrificial anodic plug for insertion within an irrigation span to provide anodic corrosion protection. According to a preferred embodiment, the anodic plug of the present invention includes a protective cap connected to a securing bushing, and an anodic coupler which extends into the interior of the irrigation span.

According to a further preferred embodiment, the securing bushing preferably includes non-conductive threads for mating with the threads of a sprinkler outlet and for electrically isolating the anodic coupler from the protective cap. According to further preferred embodiments, the anodic coupler is formed of magnesium and extends down away from the protective cap and terminates in an anodic base.

According to a further preferred embodiment, the protective cap may include a wear indicator which provides an indication of the amount of anodic material remaining in the central anodic coupler and anodic base.

These and other advantages and features of the present invention are described with specificity in the descriptions below to make the present invention understandable to one of ordinary skill in the art.

BRIEF DESCRIPTION OF THE DRAWINGS

Elements in the figures have not necessarily been drawn to scale in order to enhance their clarity and improve understanding of these various elements and embodiments of the invention. Furthermore, elements that are known to be common and well understood to those in the industry are not depicted in order to provide a clear view of the various embodiments of the invention, thus the drawings are generalized in form in the interest of clarity and conciseness. It should be understood that the scope of the present invention is intended to be limited solely by the appended claims.

DETAILED DESCRIPTION OF THE DRAWINGS

In the following discussion that addresses a number of embodiments and applications of the present invention, reference is made to the accompanying drawings that form a part hereof, and in which is shown by way of illustration specific embodiments in which the invention may be practiced. It is to be understood that other embodiments may be utilized, and changes may be made without departing from the scope of the present invention.

Various inventive features are described below that can each be used independently of one another or in combination with other features. However, any single inventive feature may not address any of the problems discussed above or only address one of the problems discussed above. Furthermore, one or more of the problems discussed above may not be fully addressed by any of the features described below.

Figure 1:
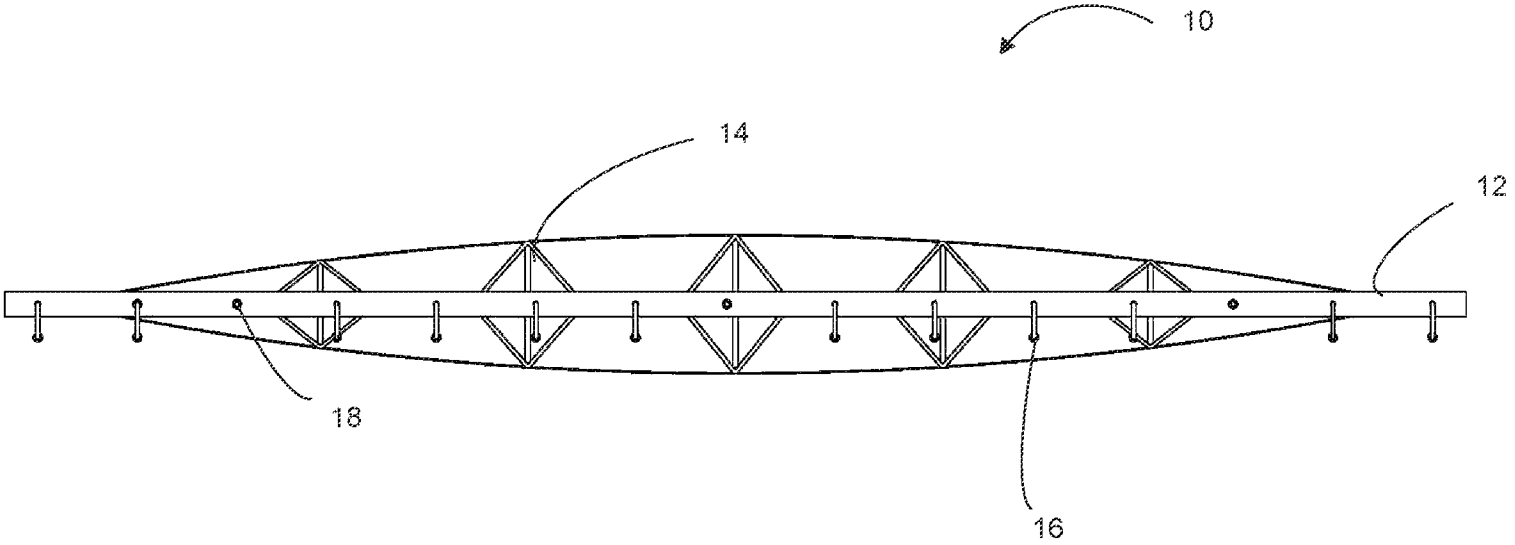
FIG. 1 shows an overhead view of an exemplary irrigation span.
Figure 2:
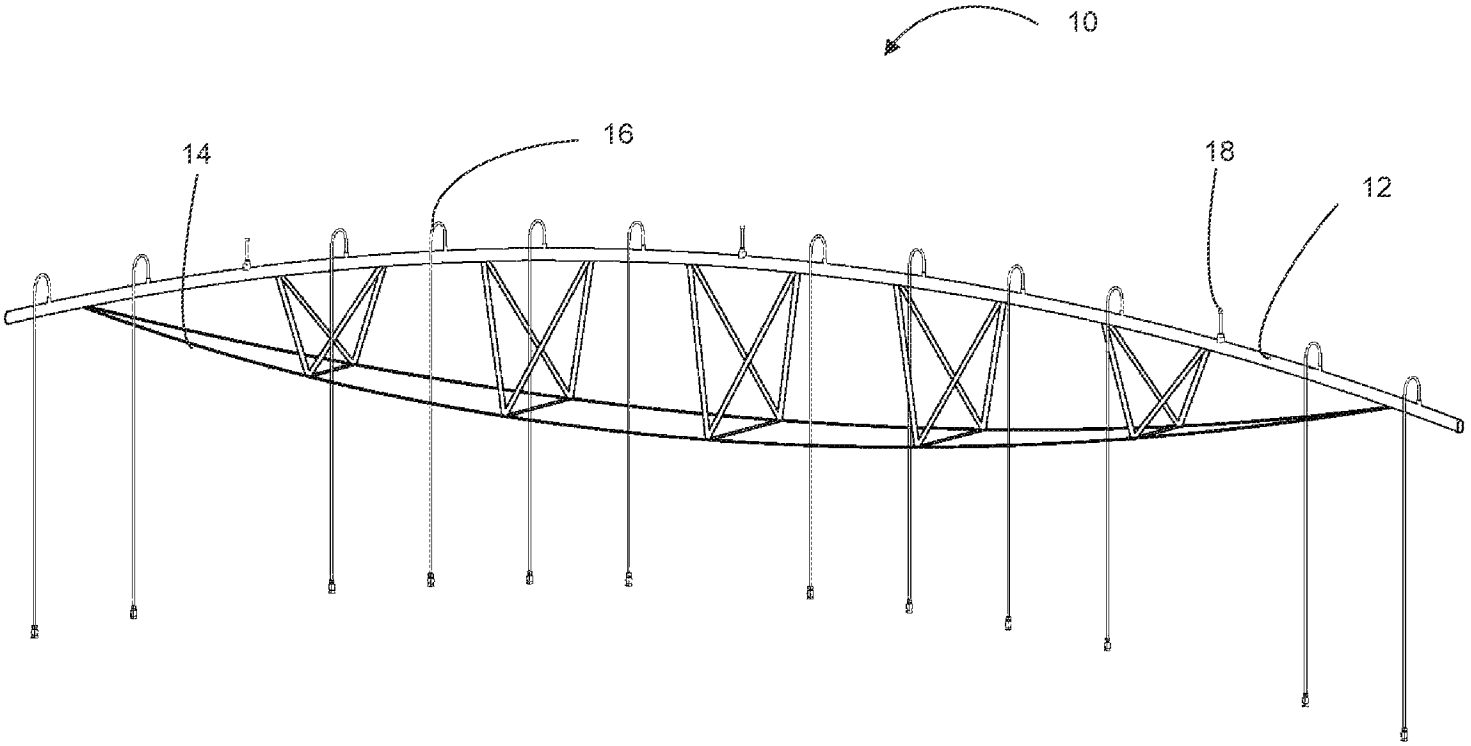
FIG. 2 shows a perspective of the exemplary irrigation span shown in FIG. 1.

With reference now to FIGS. 1 and 2, an exemplary irrigation section 10 is shown including an irrigation span 12 and a supporting truss system 14. In operation, the irrigation span 12 carries a flow of water from a central water source or pivot point (not shown) through the irrigation span 12 and out through a variety of sprinklers such as dropdown sprinklers ("drops") 16 and upright spray nozzles 18.

Figure 3A:
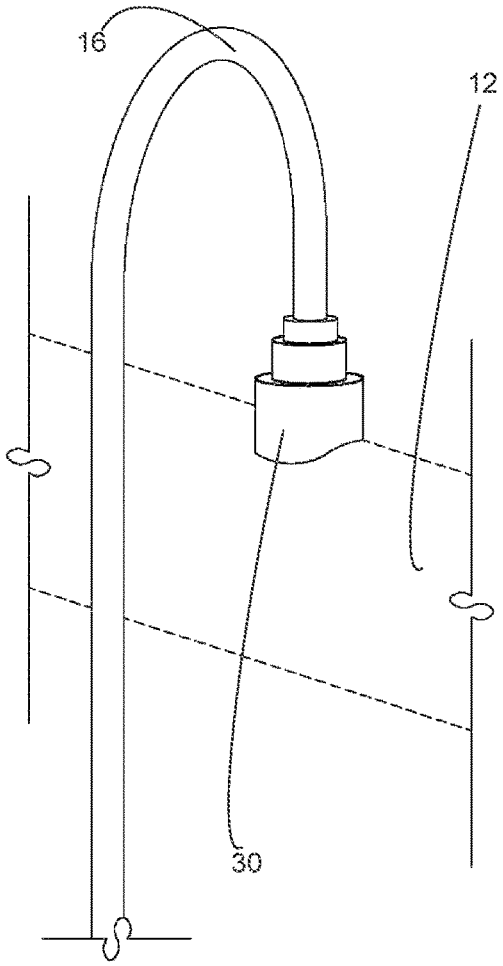
FIG. 3A shows drop sprinkler configuration with the drop sprinkler installed within a first sprinkler outlet.
Figure 3B:
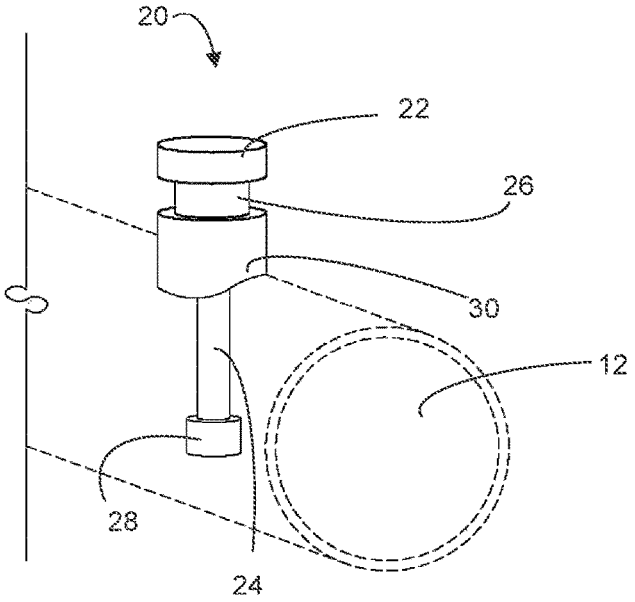
FIG. 3B shows an exemplary plug-anode installed within a first sprinkler outlet in place of the drop sprinkler in accordance with a first preferred embodiment of the present invention.
Figure 4A:
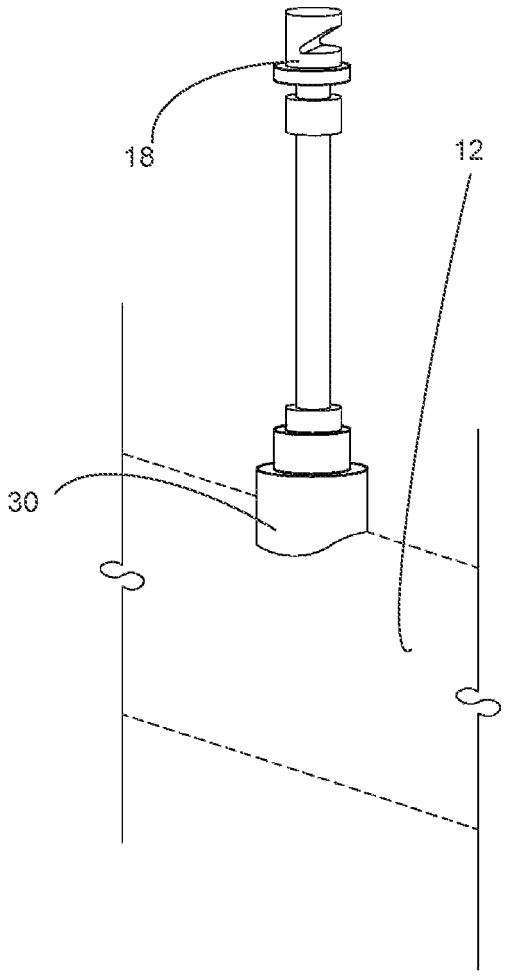
FIG. 4A shows conventional nozzle sprinkler configuration with a sprinkler nozzle installed in a first sprinkler outlet.

With reference now to FIGS. 3A-3B, according to a first preferred embodiment, the present invention includes the use of plug anodes 20 in place of selected drops 16 and/or spray nozzles 18 along the length of the irrigation span 12. With reference to FIG. 3A, a span 12 is shown with a standard drop sprinkler 16 installed in a sprinkler outlet 30. With reference to FIG. 3B, the drop sprinkler 16 is shown replaced by a plug anode 20 designed in accordance with the present invention. Similarly, FIG. 4A shows an irrigation span 12 with a spray nozzle 18 inserted within a sprinkler outlet 30 and FIG. 4B shows an exemplary plug anode 20 used in place of the spray nozzle 18.

Figure 4B:
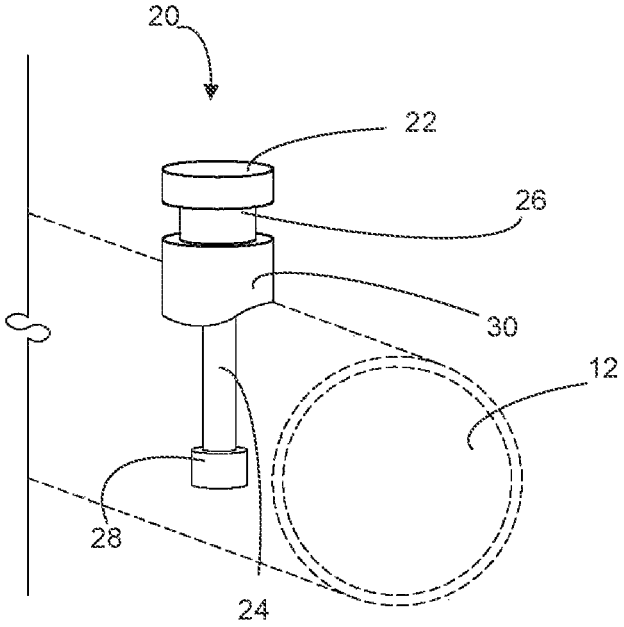
FIG. 4B shown an exemplary plug-anode installed within a first sprinkler outlet in place of the sprinkler nozzle in accordance with an alternative preferred embodiment of the present invention.

As shown in FIGS. 3B and 4B, the exemplary plug anode 20 may preferably include a protective cap 22, a securing bushing 26, a central anodic coupler 24, and an anodic base 28. Preferably, the protective cap 22 may include a grip surface to allow the plug anode 20 to be inserted and screwed into the sprinkler outlet 30. According to a preferred embodiment, the anodic coupler 24 and the anodic base 28 may be formed of magnesium. Alternatively, the anodic coupler 24 and the anodic base 28 may be formed of other anodic materials such as zinc, aluminum or the like.

Preferably, the bushing 26 may further include non-conductive threads to allow the plug anode 20 to be easily screwed into and removed from the sprinkler outlet 30. The bushing 26 may preferably electrically isolate the anodic coupler 24 from the protective cap 22. According to a further preferred embodiment, the cap 22 of the plug anode 20 may preferably further include a label, meter or other wear indicator to track and alert the machine operator regarding the remaining effective lifespan of the plug anode 20.

In operation, the plug anode 20 is preferably electrically connected to the irrigation span 12 via the anodic coupler 24 which may be in physical contact with the pipe 12. Alternatively, the plug anode 20 may be electrically connected to the irrigation span through the bushing 26 which may physically contact the sprinkler outlet 30, which in turn is in physical contact with the pipe 12. According to an alternative embodiment, the electrical connection may alternatively be made via a dedicated wire (not shown) or via conductive threads on the bushing 26.

As discussed above, the plug anode 20 of the present invention may preferably be inserted into unused sprinkler outlets 30 along the span or they may replace unneeded sprinklers. Alternatively, additional sprinkler outlets 30 may be drilled into a given irrigation span 12 so that needed plug anodes 20 may provide additional protection to the steel span. The number of protective anode plugs 20 needed for each span may be calculated based on the pipe diameter, flow and the length/diameter/material of the plug anode 20. Where fewer sprinkler outlets are available, the dimensions of the anodic coupler 24 and base 28 may be lengthened and expanded to provide the needed level of exposed surface area. Additionally, the anode plug 20 may include multiple anodic couplers 24 and bases 28 which may be compressed together for insertion into the sprinkler outlet 30 and mechanically expanded within the span 12 using springs or other similar mechanisms.

Figure 5:
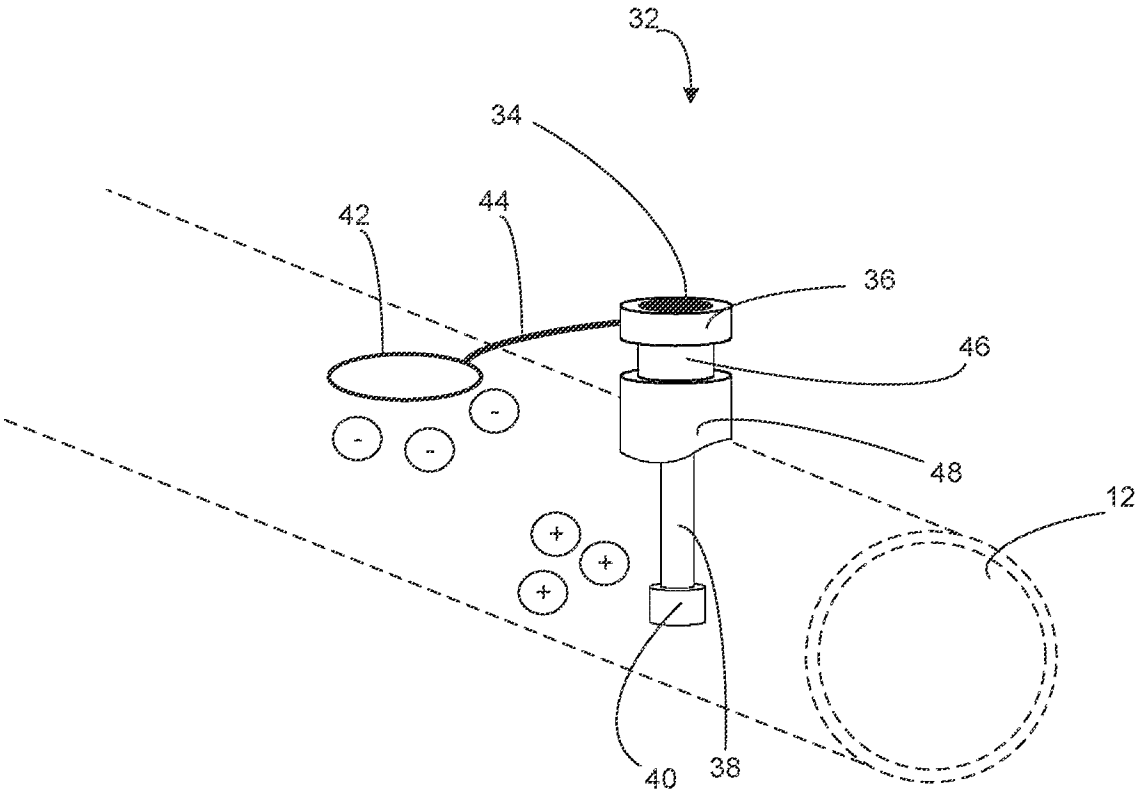
FIG. 5 shows an alternative embodiment of the present invention incorporating an impressed current cathodic protection (ICCP) system.

Referring now to FIG. 5, according to alternative embodiments, the present invention may include an impressed current cathodic protection (ICCP) system along with or in place of the passive system discussed above. As shown in FIG. 5, an exemplary ICCP embodiment 32 may include a rectifier 34 which is preferably built into or connected to the protective cap 36.

As shown in FIG. 5, the rectifier 34 may be formed with a solar panel and/or battery system which may provide positive DC current into the central anodic coupler 38 and the anodic base 40. According to alternative embodiments, the DC current of the present invention may come from many alternative sources including an AC power source via a transformer-rectifier system. According to preferred embodiments, the DC voltage of the present invention may be adjusted as needed to facilitate or enhance the electrochemical reactions of the system.

With reference again to FIG. 5, the negative terminal of the rectifier 34 may be connected to the inner or outer pipe surfaces via a connecting wire 44. Such a connecting wire 44 may connect directly to the pipe surface or may be secured using a conductive patch 42 or the like. According to alternative embodiments, the conductive wire 44 may be formed within or run through the body of the securing bushing 46 and/or the sprinkler outlet 48 so that no external wire 44 is needed. Further, the conducting wire 44 may be taped or otherwise secured to the surface of the pipe 12.

The foregoing description of the preferred embodiment of the present invention has been presented for the purpose of illustration and description. It is not intended to be exhaustive or to limit the invention to the precise form disclosed. Many modifications and variations are possible in light of the above teachings. It will be readily appreciated that many deviations may be made from the specific embodiments disclosed in this specification without departing from the spirit and scope of the invention. Accordingly, the scope of the invention is to be determined by the claims below rather than being limited to the specifically described embodiments above.

I claim:

1. An apparatus for providing anodic corrosion protection for a galvanized irrigation pipe having an exterior surface, wherein the apparatus comprises:

a protective cap, wherein the protective cap comprises a main body having a first perimeter; wherein the protective cap comprises a gripping surface; wherein the gripping surface extends around the first perimeter of the main body;

a securing bushing;

a solar panel, wherein the solar panel is integrated within the main body of the protective cap; wherein the solar panel is within the first perimeter of the main body;

a first conductive wire, wherein the first conductive wire comprises a first end and a second end; wherein the first conductive wire is electrically connected at the first end to the solar panel;

a conductive patch, wherein the conductive patch is electrically connected to the second end of the first conductive wire; wherein the conductive patch is electrically connected to the galvanized irrigation pipe; wherein the conductive patch comprises a planar surface extending away from the first conductive wire in a direction parallel to the exterior surface of the galvanized irrigation pipe;

a first anodic coupler, wherein the first anodic coupler extends down away from the protective cap and terminates in a first anodic base;

a second anodic coupler, wherein the second anodic coupler extends down away from the protective cap and terminates in a second anodic base.

2. The apparatus of claim 1, wherein the apparatus further comprises:

a spring element, wherein the spring element is connected at a first side to the first anodic coupler; wherein the spring element is connected at a second side to the second anodic coupler; wherein the spring element is deformable between a first compressed state and a second uncompressed state;

wherein the first anodic coupler and the second anodic coupler are a first lateral distance apart when the spring element is in the first compressed state; wherein the first anodic coupler and the second anodic coupler are a second lateral distance apart when the spring element is in the second uncompressed state; wherein the first lateral distance is smaller than the second lateral distance.

* * * * *